US005265405A

United States Patent [19]

Stahlecker

[11] Patent Number: 5,265,405

[45] Date of Patent: Nov. 30, 1993

[54] SPINNING MACHINE WITH A CONVEYOR BELT FOR CONVEYING MULTIPLE SLIVERS TO RESPECTIVE SEPARATE SPINNING STATIONS

[75] Inventor: Fritz Stahlecker, Bad Überkingen, Fed. Rep. of Germany

[73] Assignee: Hans Stahlecker, Süssen, Fed. Rep. of Germany

[21] Appl. No.: 846,889

[22] Filed: Mar. 6, 1992

[30] Foreign Application Priority Data

Mar. 20, 1991 [DE] Fed. Rep. of Germany ..... 4109097

[51] Int. Cl.[5] ..... D01H 13/04

[52] U.S. Cl. ..... 57/90; 226/171; 226/172

[58] Field of Search ..... 57/90, 315; 226/170, 226/171, 172

[56] References Cited

U.S. PATENT DOCUMENTS

| | | | |
|---|---|---|---|
| 2,896,269 | 7/1959 | Gardella et al. | 57/315 X |
| 3,070,948 | 1/1963 | Tsuzuki | 57/315 X |
| 3,312,050 | 4/1967 | Noguera | 57/90 |
| 4,022,007 | 5/1977 | Motobayashi et al. | 57/90 X |
| 4,976,096 | 12/1990 | Sawhney et al. | 57/315 X |

FOREIGN PATENT DOCUMENTS

| | | |
|---|---|---|
| 817572 | 10/1951 | Fed. Rep. of Germany . |
| 2335740 | 11/1974 | Fed. Rep. of Germany . |

*Primary Examiner*—Joseph J. Hail, III

*Attorney, Agent, or Firm*—Evenson, McKeown, Edwards & Lenahan

[57] ABSTRACT

In the case of a spinning machine for the spinning of yarns from slivers which are fed in cans, the slivers are guided from the cans to the spinning stations by guiding devices. The guiding devices comprise a driven conveyor belt for at least two slivers which are to be conveyed side-by-side.

17 Claims, 4 Drawing Sheets

FIG. 2
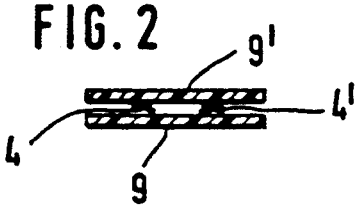
FIG. 3
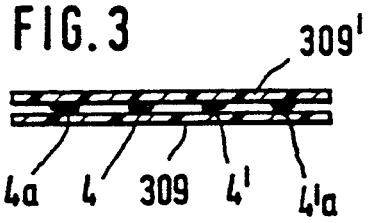
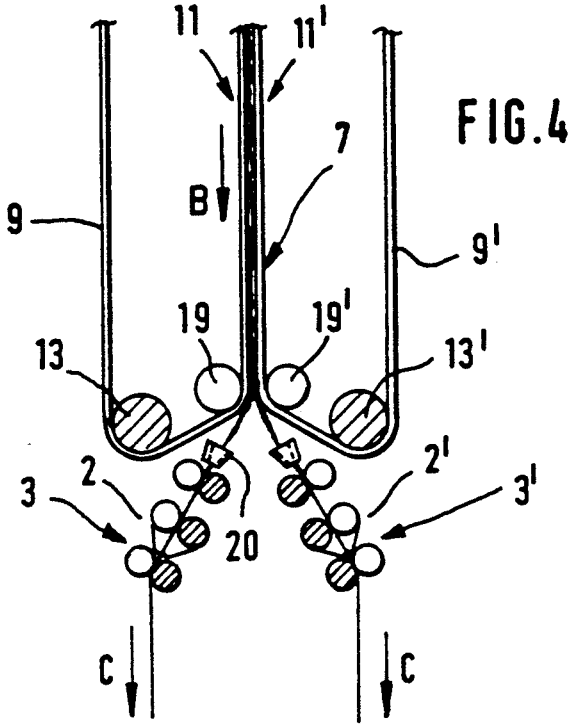
FIG. 4
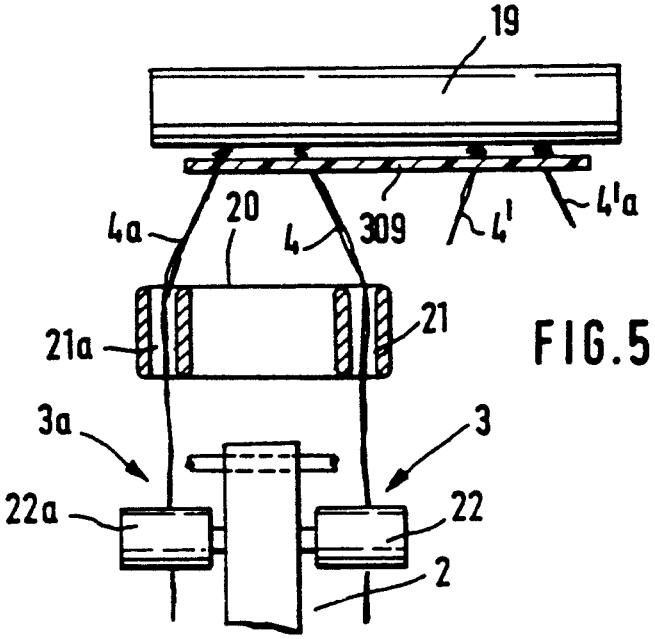
FIG. 5

SPINNING MACHINE WITH A CONVEYOR BELT FOR CONVEYING MULTIPLE SLIVERS TO RESPECTIVE SEPARATE SPINNING STATIONS

BACKGROUND AND SUMMARY OF THE INVENTION

The invention relates to a spinning machine having several spinning stations for spinning yarns from slivers which are fed to the spinning stations in cans, guiding devices for the slivers being provided between the cans and the spinning stations.

The feeding of the fiber material, that is to be spun, in the form of slivers situated in cans, is known, for example, in the case of open-end spinning machines. In the case of the machines that are on the market, the slivers are withdrawn directly by the sliver feeding device of the individual spinning stations from the cans which stand in front of and partially under the spinning arrangement.

It is also known (German Patent Document DE-C 23 35 740) to arrange the cans on a platform above the spinning machine in the case of open-end spinning machines and to feed the slivers to the spinning stations through guiding tubes. These guiding tubes, which are provided with baffles, are to serve as an intermediate storage device which, because of a special construction, is fed by a continuously running feeding device nevertheless intermittently. The sliver is then, essentially without tensile stress, to be guided through the respective guiding tube.

The feeding of fiber material in the form of slivers made available in cans is known also in the case of other fast-running spinning machines, such as in the case of wind-around spinning machine or air spinning machines. As a rule, these are one-sided machines where the slivers are fed to the spinning stations from above and are removed from the cans deposited on the rear of the spinning machine. In this case, guiding devices for the slivers are provided in the form of rollers and guide rods.

It is also known (German Patent Document DE-PS 817 572) to feed slivers in cans in the case of ring spinning machines, in which case, the cans are deposited on platforms or in a space above the spinning machine. This results in relatively long travelling paths with one or several vertical sections which carry the risk that the slivers may hang out, that is, are drawn or drafted uncontrollably because of their own weight. Such an arrangement is therefore possible only for slivers which have a relative coarse size and therefore have a relatively high strength.

However, the spinning of coarse-size slivers is very difficult on ring spinning machines. Since the ring spinning machines have only a relatively slow delivery speed on the outlet of the drafting units, the feeding rollers of the drafting units—taking into account the required drafting—must run very slowly, that is, at rotational speeds of one revolution per minute or less. Technically, it is extremely difficult to let long shafts, like the feeding rollers of drafting units, run with sufficient precision at such low rotational speeds. There is the risk that these shafts may only turn jerkily so that no controlled drafting is obtained. The feeding of the fiber material that is to be spun in cans has therefore in practice not been carried out successfully in the case of ring spinning machines.

In an older German Patent Application (P 40 41 112.5, PA 1170, P 9342, which is no prior publication, (corresponding U.S. patent application Ser. No. 07/809,141, filed Dec. 18, 1991 now abandoned and subsequent continuation-in-part application Ser. No. 07/948,638, filed Sep. 23, 1992) it is suggested to provide a conveyor belt for the guiding devices. In this case, a separate conveyor belt is assigned to each sliver, against which a sliding skid or a second belt may possibly place itself.

It is an object of the invention to develop a spinning machine of the initially mentioned type such that also fine slivers may be fed in the cans without the risk of faulty drafting, in which case the manufacturing expenditures should be kept low.

This object is achieved according to preferred embodiments of the invention in that the guiding devices comprise a conveyor belt for at least two slivers which are to be conveyed side-by-side.

In the development according to the invention, it is achieved that the slivers are supported and are nevertheless moved in the transport direction. As a result, it is possible to feed also relatively thin slivers in cans, that is, slivers of sizes of approximately Nm 0.4 to 0.8. In this case, these fine slivers may also be conveyed in the vertical direction along larger sections. It is therefore possible to carry out a can feeding also in the case of ring spinning machines since, because of the fine-sized slivers, while taking into account the drafting, the feeding roller pairs of the drafting units still rotate at a sufficiently high speed so that a uniform round rotating is ensured. By means of this can feeding, it will then be possible in the case of ring spinning machines to do without a machine, specifically the flyer, connected in front of it. In the case of other spinning machines, which are provided with drafting units into which slivers enter, it is possible to feed finer slivers so that the drafting units can then be simplified. For example, in the case of such machines, there exists the possibility of using, instead of five-cylinder drafting units, the three-cylinder drafting units which today are customary in the case of ring spinning machines.

The feeding of finer slivers also has advantages in the case of open-end machines because then the opening work for the separating of the fibers is less so that the fibers are processed more carefully during the opening-up. It is therefore possible to spin finer yarns with less damaged fibers so that the yarns have a higher quality.

As a result of the fact that several slivers are assigned to one conveyor belt, the manufacturing expenditures are reduced because one conveyor belt can transport the slivers of several spinning stations. In this case, it may be provided that two slivers to be transported side-by-side are assigned to different sides of the machine. As an alternative or addition, it may, however also be provided that the two slivers, which are to be conveyed side-by-side, are assigned to the same side of the machine.

Other objects, advantages and novel features of the present invention will become apparent from the following detailed description of the invention when considered in conjunction with the accompanying drawings.

BRIEF DESCRIPTION OF THE DRAWINGS

FIG. 2 is a partial cross-sectional view of FIG. 1 with two slivers arranged side-by-side between the two conveyor belts;

FIG. 3 is a cross-sectional view similar to FIG. 2, showing an embodiment with four slivers arranged side-by-side;

FIG. 4 is a partial view similar to FIG. 1, showing an embodiment with additional deflecting rollers of the conveyor belts in the area of the drafting units;

FIG. 5 is a schematic view of a modified embodiment as compared to FIG. 4, with a sliver guide for guiding the slivers apart in front of the drafting unit;

DETAILED DESCRIPTION OF THE DRAWINGS

Figure 1:
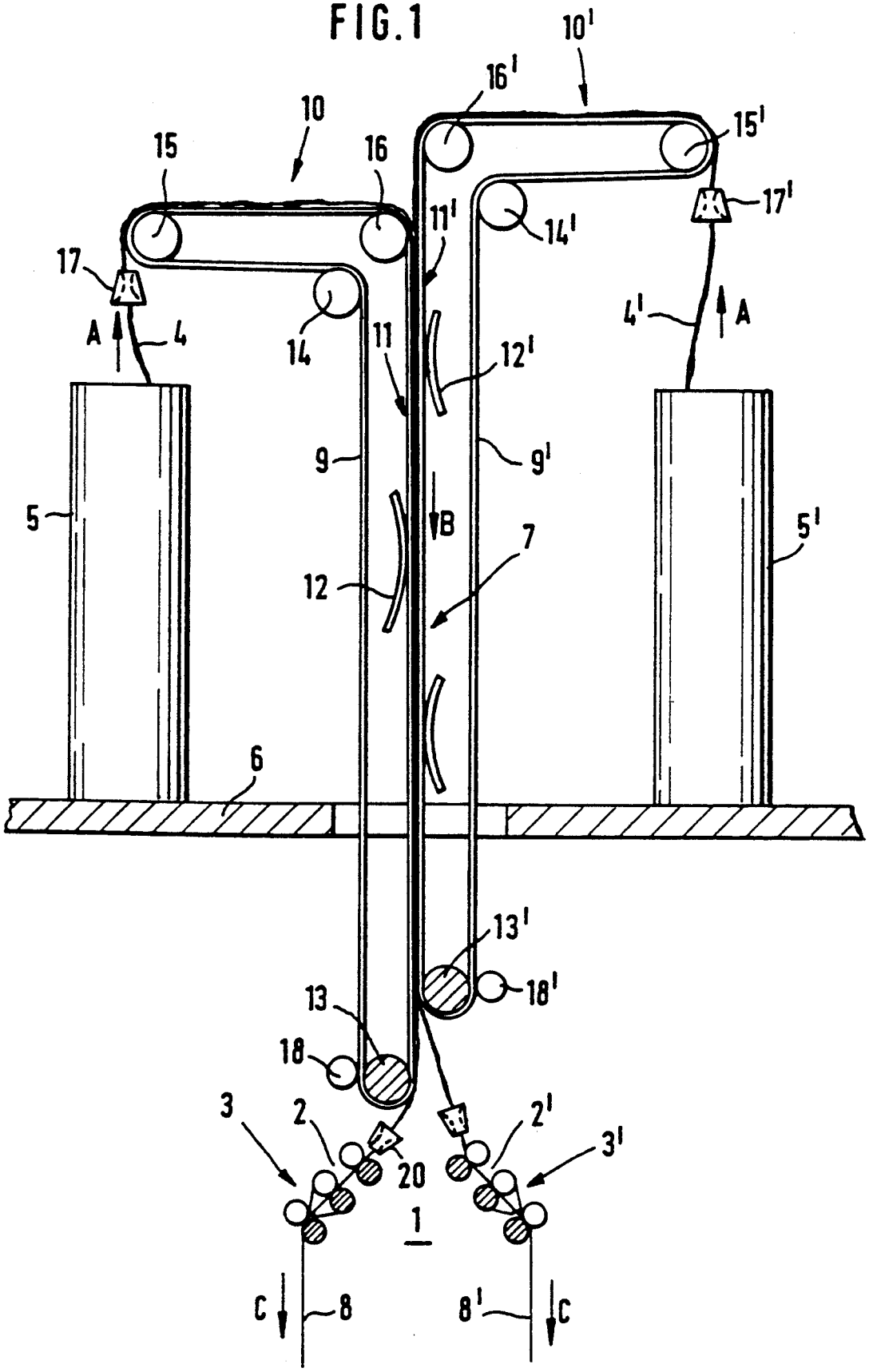
FIG. 1 is a partial cross-sectional schematic view of a two-sided spinning machine constructed according to a preferred embodiment of the invention, only one drafting unit respectively of each side being shown, to which a sliver is fed from a can deposited on a platform, the slivers of both machine sides being transported side-by-side between two conveyor belts pressed against one another.

Of a two-sided spinning machine 1, FIG. 1 only shows the drafting units 2 and 2' of the pertaining spinning stations 3 and 3'. However, this type of a spinning machine 1 comprises a plurality of such spinning stations 3, 3' which are arranged in a row next to one another on each side of the machine. As an alternative, it is also contemplated to use the invention for a one-sided spinning machine.

Each drafting unit 2, 2' is followed by a twist providing machine, which is not shown, such as a ring spindle or a wind-around spindle or an air nozzle. Likewise, a sliver feeding device of an open-end spinning machine may be situated at the location of the drafting unit 2, 2'. At each of these spinning stations 3, 3', a sliver 4, 4' is withdrawn in the direction of the arrow A from one can 5, 5' respectively and spun into a yarn.

In the embodiment according to FIG. 1, the cans 5, 5' of the individual spinning stations 3, 3' stand on a platform 6 above the spinning machine 1. The cans 5, 5', which normally have an outside diameter which is larger than the division of the spinning stations 3, 3' (spacing of the spinning stations 3, 3' in the longitudinal direction of the machine), are deposited in several rows 5, 5' extending in the longitudinal direction of the spinning machine 1.

Slivers 4, 4' are withdrawn upward in the direction of the arrow A from the cans 5, 5', which are open on top, and are then transported downward in the direction of the arrow B to the drafting units 2, 2'. In order to securely bridge this travelling path also in the case of fine sizes of the slivers 4, 4' without the occurrence of faulty drafting in the fine slivers 4, 4', special guiding devices 7 are provided.

Behind the drafting units 2, 2', the drafted yarns 8 and 8' are then fed in the direction of the arrow C to a twist providing device which is not shown.

The guiding devices 7 comprise two conveyor belts 9 and 9' disposed opposite one another. They each circulate continuously and extend from above the cans 5, 5' along a horizontal section 10 or 10' and then converge above the machine center where, while being slightly pressed against one another, they bridge a vertical section 11 and 11'. Alternatinqly disposed skids 12 and 12' ensure that the conveyor belts 9, 9' are softly placed against one another.

The conveyor belt 9 is guided over a total of four deflecting rollers 13, 14, 15, 16. In corresponding manner, the conveyor belt 9' extends over deflecting rollers 13', 14', 15' and 16'. The deflecting rollers 13, 13', which are situated in the area of the drafting units 2, 2', are also used as driving disks for the pertaining driving belt 9, 9'. The deflecting rollers 15, 15' are each situated approximately centrically above the pertaining can 5, 5' and are therefore used as so-called lift-out rollers. The remaining two deflecting rollers 14 and 16 or 14' and 16', in each case, define the transition between the horizontal section 10, 10' and the vertical section 11, 11' of the guiding devices 7.

Between the cans 5, 5' and the lift-out rollers 15, 15' one sliver guide 17 and 17' respectively is disposed which is constructed as a feeding hopper. The sliver guides 17, 17', which belong to two opposite spinning stations 3, 3' of both machine sides, are slightly offset with respect to one another in the longitudinal direction of the spinning machine 1, which has the effect that the slivers 4 and 4', when they meet in the vertical section 11, 11' of the conveyor belt 9, 9' do not travel above one another but next to one another. This is illustrated in the sectional drawing of FIG. 2. The same can also be implemented when two slivers 4 and 4*a* for each side of the machine are combined, as shown in FIG. 3. The slivers 4 and 4*a* pertain to two adjacent spinning stations 3 and 3*a* of one side of the machine, while the slivers 4' and 4'a of two adjacent spinning stations 3' and 3'*a* pertain to the other side of the machine. In this case, the four slivers 4, 4*a*, 4', and 4'*a* are held by two conveyor belts 309 and 309'. In the embodiment according to FIG. 3, whose conveyor belts 309 and 309' may also be installed in the arrangement according to FIG. 1, a total of four slivers 4, 4*a*, 4' and 4'*a* therefore travel in the machine center, in each case, on a common conveyor belt 309 or 309.

It is advantageous for the driving rollers 13, 13' as well as the deflecting rollers 16, 16', which are used for pressing the conveyor belts 9, 9' against one another, to be slightly offset with respect to one another as far as the height is concerned, as indicated in FIG. 1. In this case, it is achieved that an excessively rigid pressing-together of the conveyor belts 9 and 9' does not occur either at the end of the respective horizontal section 10, 10' or at the end of the vertical section 11, 11'. In the present case, the conveyor belt 9', after leaving the upper deflecting roller 16' constructed as a corner roller, places itself elastically against the upper corner roller 16 of the opposite belt 9. It is not important in this case that the mounting is precise with respect to millimeters. Also in the area of the drafting units 2 and 2', the conveyor belt 9 is placed elastically against the driving roller 13' of the other transport belt 9'.

So that the conveyor belts 9 and 9' are driven by the driving rollers 13, 13' without any slip, rubber rollers 18 and 18' are assigned which are resiliently placed against the driving rollers 13, 13', like the pressure rollers of a drafting unit. The driving rollers are corrugated.

The offset arrangement of the driving rollers 13, 13' also takes into account the circumstance that these driving rollers 13, 13' are constructed to extend through the spinning machine I in the longitudinal direction and therefore require a certain distance from one another. If, nevertheless, no offset arrangement is to be used, the arrangement according to FIG. 4 may be applied in the area of the drafting units 2, 21. In this embodiment, deflecting rollers 19, 19' are added which bound the respective vertical section 11, 11' so that the actual driving rollers 13, 13' may be arranged at a slightly larger horizontal distance from one another. In that case, the so-called creel mast can then be guided through between the driving rollers 13 and 13' from the spinning machine 1 through the platform 6 in the upward direction and carries the upper deflecting rollers 14, 15 and 16 as well as 14', 15' and 16'.

When, according to FIG. 3, two slivers 4 and 4a of one side of the machine or 4' and 4'a of the other side of the machine are guided side-by-side by the two conveyor belts 309 and 309', it is necessary that the slivers 4 and 4a, which travel through two adjacent spinning stations 3, 3a respectively, be slightly led apart before entering into the respective drafting unit 2. The reason is that the slivers 4 and 4a lie relatively close to one another on the conveyor belt 309 in order to keep the dimensions of the transport belt 309 as small as possible. One sliver guide 20 respectively is used for the guiding-apart of the slivers 4 and 4a (also of the slivers 4' and 4'a of the other machine side), the guiding ducts 21 and 21a of the sliver guide 20 corresponding to the space between the respective feeding rollers 22 and 22'a of the drafting units 2 (FIG. 5).

Figure 6:
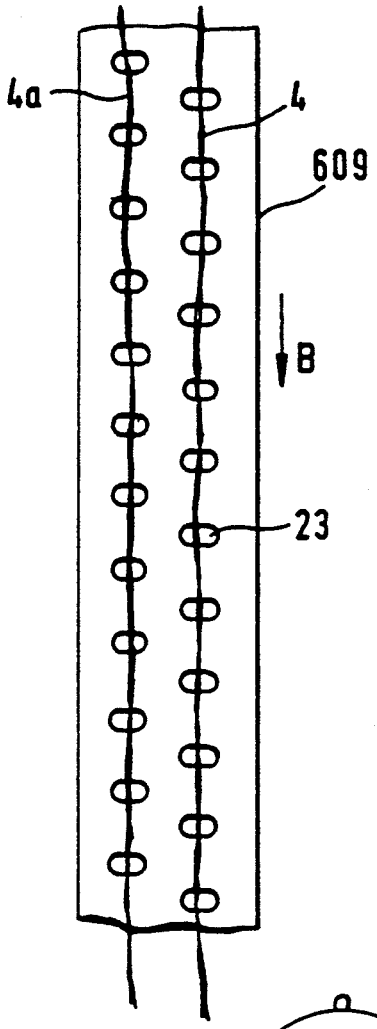
FIG. 6 is a view of a conveyor belt, showing an embodiment with two rows of holes.

In the embodiment according to FIG. 6, a single conveyor belt 609 is used for the conveying of the slivers 4 and 4a of one side of the machine disposed side-by-side. In the case of this conveyor belt 609, it is not necessary that a second belt is placed against it. A corresponding conveyor belt of the other machine side may therefore have a certain distance from the conveyor belt 609 above the machine center.

The conveyor belt 609 provided for two slivers 4 and 4a has two rows of holes 23. These are rectangular or longitudinally oval breakthroughs which extend in the transverse direction of the conveyor belt 609. Above the cans 5, the slivers 4 and 4a are each, in their row of holes 23, rolled onto the conveyor belt 609. This is illustrated in FIG. 7.

Figure 7:
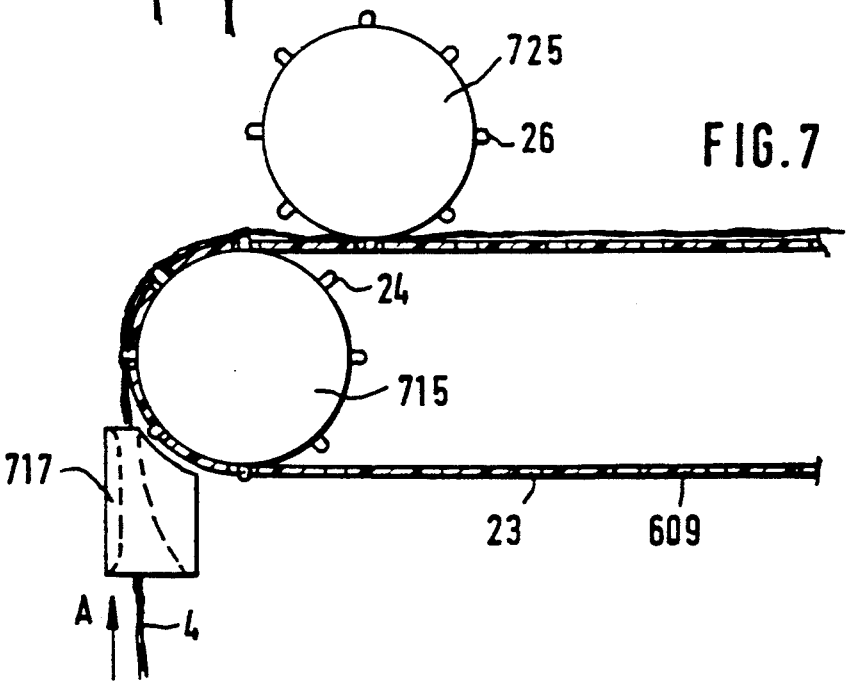
FIG. 7 is a partial view similar to FIG. 1 in the area where two slivers travel onto the conveyor belt of FIG. 6.

FIG. 7 shows the deflecting roller 715, which is arranged above the sliver guide 717 and is provided with small cams 24 which engage in the holes 23. A sliver receiving roller 725 is assigned to the deflecting roller 715 and also has cams 26 which engage in the holes 23. By means of the cams 26, the slivers 4 and 4a will then be pressed more or less far into the hole 23. As a result, the slivers 4 and 4a are intimately connected with the conveyor belt 609 so that the desired adherence is generated. Individual fibers of the slivers 4 and 4a are securely pressed into the holes 23 constructed as windows.

Figure 8:
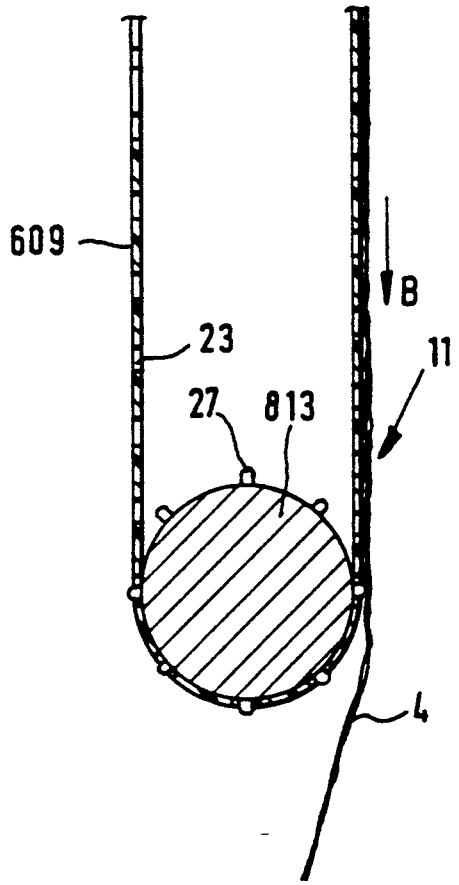
FIG. 8 is a partial view of a modified FIG. 1 arrangement in the area where the slivers move away from the conveyor belt according to FIG. 6.

FIG. 8 illustrates the area of the driving roller 813 for the conveyor belt 609. This driving roller 813 is also equipped with cams 27 which engage in the holes 23. These cams of the driving roller 813, on the one hand, are used for the form-locking drive of the conveyor belt 609 and, on the other hand, for pressing the slivers 4 and 4a away from the conveyor belt 609 at the end of the vertical section.

Figure 9:
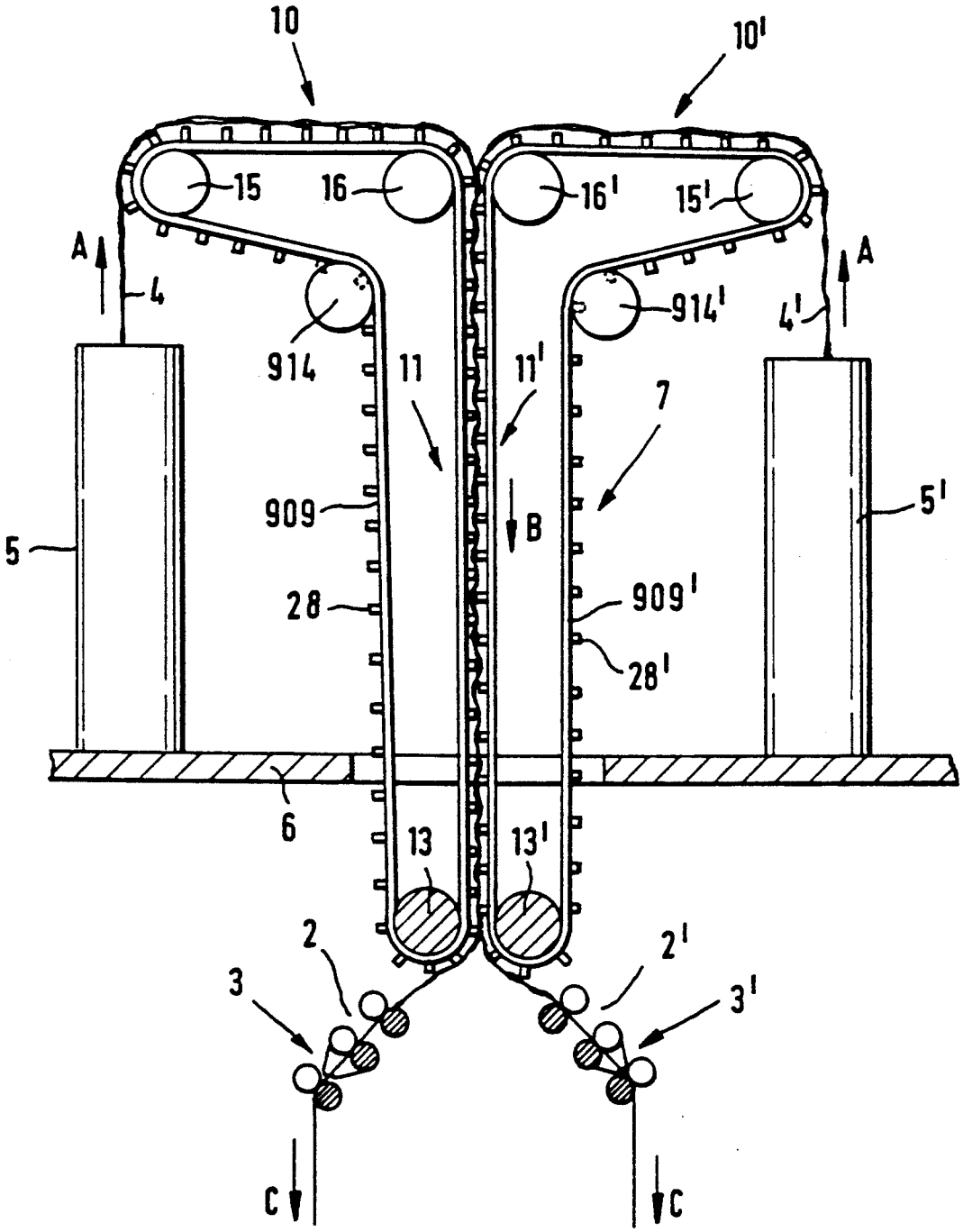
FIG. 9 is a partial cross-sectional view similar to FIG. 1 showing another embodiment of the invention.

The embodiment according to FIG. 9 corresponds largely to FIG. 1, in which case the same components have the same reference number. These components were therefore not described again.

In the embodiment according to FIG. 9, the conveyor belts 909 and 909' are provided with cheeks 28 and 28' on the outside which are arranged to fill gaps in the vertical section 11 and 11'. The slivers 4 and 4', which extend side-by-side, are therefore deflected in a slalom-type manner which results in a sufficient frictional securing. In this case, the deflecting rollers 914 and 914', which are assigned to the cheeks 28 and 28', have corresponding recesses for the cheeks 28, 28'.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A spinning machine comprising:

a plurality of spinning stations for spinning yarns from slivers which are fed to the spinning stations in cans, and guiding devices for guiding the slivers between the cans and the spinning station, wherein the guiding devices comprise:

a conveyor belt for at least two slivers to be conveyed side-by-side to respective separate spinning stations, and sliver separation elements at the downstream end of the conveyor belt for separating and guiding the slivers to the respective separate spinning stations.

2. A spinning machine according to claim 1, wherein two slivers to be conveyed side-by-side are assigned to different sides of the machine.

3. A spinning machine according to claim 2, wherein the silver separation elements include sliver guides in the form of respective sliver guiding ducts arranged behind the conveyor belt for leading the respective slivers apart at the end of their travel path on the conveyor belt.

4. A spinning machine according to claim 2, wherein the guiding devices include two sliver guides arranged in front of the conveyor belt which pertain to different sides of the machine and which are offset with respect to one another transversely with respect to the conveyor belt.

5. A spinning machine according to claim 4, wherein the guiding devices include two continuous conveyor belts which hold the slivers between one another and travel over deflecting rollers, the deflecting rollers of the two conveyor belts which correspond to one another being offset with respect to one another in the travelling direction of the conveyor belts.

6. A spinning machine according to claim 1, wherein two respective slivers to be conveyed side-by-side are assigned to the same side of the machine.

7. A spinning machine according to claim 6, wherein the silver separation elements include sliver guides in the form of respective sliver guiding ducts arranged behind the conveyor belt for leading the respective slivers apart at the end of their travel path on the conveyor belt.

8. A spinning machine according to claim 1, wherein the guiding devices include two sliver guides arranged in front of the conveyor belt which pertain to different sides of the machine and which are offset with respect to one another transversely with respect to the conveyor belt.

9. A spinning machine according to claim 1, wherein the guiding devices include two continuous conveyor belts which hold the slivers between one another and travel over deflecting rollers, the deflecting rollers of the two conveyor belts which correspond to one another being offset with respect to one another in the travelling direction of the conveyor belts.

10. A spinning machine according to claim 1, wherein the guiding devices include at least one of a sliver receiving roller and a sliver delivery roller assigned to the conveyor belt.

11. A spinning machine according to claim 1, wherein the cans are arranged on a platform through which the conveyor belt is guided.

12. A spinning machine according to claim 1, wherein the conveyor belt has plural rows of holes extending side-by-side along the length of the conveyor belt, and wherein a sliver insertion roller is provided which has cams engageable into the holes to secure the sliver to the conveyor belt.

13. A spinning machine according to claim 12, further comprising a belt deflecting roller with cams engageable into the holes to release the sliver from the conveyor belt.

14. A spinning machine according to claim 1, wherein each of said spinning stations includes a three-cylinder drafting unit.

15. A spinning machine comprising:

a plurality of spinning stations for spinning yarns from slivers which are fed to the spinning stations in cans, and guiding devices for guiding the slivers between the cans and the spinning stations, wherein the guiding devices comprise a conveyor belt for at least two slivers to be conveyed side-by-side, wherein the conveyor belt has plural rows of holes extending side-by-side along the length of the conveyor belt, and wherein a sliver insertion roller is provided which has cams engageable into the holes to secure the sliver to the conveyor belt.

16. A spinning machine according to claim 15, wherein a belt deflecting roller with cams engageable into the holes to release the sliver from the conveyor belt.

17. A spinning machine according to claim 15, wherein each of said spinning stations includes a three-cylinder drafting unit.

* * * * *